United States Patent [19]

Takeda et al.

[11] Patent Number: 4,490,696

[45] Date of Patent: Dec. 25, 1984

[54] CROSSED WAVEGUIDE TYPE POLARIZATION SEPARATOR

[75] Inventors: Fumio Takeda; Osami Ishida; Yoji Isoda, all of Kamakura, Japan

[73] Assignee: Mitsubishi Denki Kabushiki Kaisha, Tokyo, Japan

[21] Appl. No.: 329,074

[22] Filed: Dec. 9, 1981

[30] Foreign Application Priority Data

Mar. 19, 1981 [JP] Japan ..... 56-40130

[51] Int. Cl.[3] ..... H01P 5/12; H01P 1/161

[52] U.S. Cl. ..... 333/137; 333/21 A

[58] Field of Search ..... 333/122, 125, 126, 129, 333/135, 137, 21 A, 21 R

[56] References Cited

U.S. PATENT DOCUMENTS

| | | | |
|---|---|---|---|
| 2,441,574 | 5/1948 | Jaynes | 333/21 A X |
| 2,921,272 | 1/1960 | Friis et al. | 333/137 |
| 2,923,895 | 2/1960 | Curtis et al. | 333/137 |
| 3,048,804 | 8/1962 | Drum | 333/137 |
| 4,047,128 | 9/1977 | Morz | 333/21 A X |

OTHER PUBLICATIONS

IEEE Transactions on Antennas and Propagation-"-Modes of Crossed Rectangular Waveguide"; H. J. Stalzer, Jr. et al., pp. 220–223.

Waveguide Handbook; N. Marcuvitz; pp. 355–360; McGraw-Hill; 1951.

International Conference on Antennas and Propagation; Part-1 Antennas (Nov. 1978) (IEE Conference, Publication Number 169); "Problems Inherent in the Design . . . " J. R. Brain et al.; pp. 213–217.

*Primary Examiner*—Paul Gensler

*Attorney, Agent, or Firm*—Oblon, Fisher, Spivak, McClelland & Maier

[57] ABSTRACT

A crossed waveguide type polarization separator comprises a crossed waveguide for propagating orthogonal linear polarized waves, at least one conductor septum fitted in the crossed waveguide to totally reflect only one polarized wave in the linear polarized waves, at least one subwaveguide for receiving one linear polarized wave formed by the total reflection of the conductor septum, and a waveguide for receiving the other linear polarized wave which is not reflected by the conductor septum.

3 Claims, 5 Drawing Figures

SOLID LINE: POLARIZED WAVE A
BROKEN LINE: " " B

CROSSED WAVEGUIDE TYPE POLARIZATION SEPARATOR

FIELD OF THE INVENTION

The present invention relates to an improvement in a polarization separator for microwave or millimeter waves.

DESCRIPTION OF THE PRIOR ART

FIG. 1 illustrates the conventional polarization separator for separating orthogonal polarized waves wherein the reference numeral (1) designates a square waveguide for propagating orthogonal polarized waves as a main waveguide, (2) designates subwaveguides connected to the main waveguide for propagating only one polarized wave, (3) designates a conductor septum having a reduced thickness, and symbols (A) and (B) respectively designate the electric field of linear polarized waves orthogonally crossing each other.

When the orthogonal polarized waves are received in the polarization separator as shown in FIG. 1, one polarized wave (B), which has an electric field direction in parallel to the conductor septum (3) provided in the main waveguide (1), is separated to enter into a pair of the subwaveguides connected to the main waveguide at a suitable position in relation to the conductor septum because the polarized wave (B) is totally reflected by the conductor septum (3). The separated waves in the subwaveguides (2) are combined in a single waveguide by a hybrid coupler such as the well known magic-T.

On the other hand, the other polarized wave (A), which has an electric field along the H plane direction of the subwaveguide (2), passes through the polarization separator without a substantial affect of the subwaveguides (2) and the conductor septum (3) because the subwaveguides (2) have a cutting-off characteristic to the polarized wave (A); the polarized wave (A) has an electric field perpendicular to the conductor septum (3) and the thickness of the conductor septum is small.

In the conventional polarization separator for separating the orthogonal polarized waves (A), (B), an adverse affect is easily caused by the subwaveguides (2) because the propagation energy of the polarized wave (A) is distributed in the connecting portion of the subwaveguides (2) to the main waveguide (1) whereby the frequency bandwidth which gives an excellent performance is narrowed disadvantageously. The disadvantage of the conventional polarization separator has been described with reference to a square waveguide as a main waveguide. The same disadvantage has been found in the conventional circular waveguide as a main waveguide.

SUMMARY OF THE INVENTION

It is an object of the present invention to overcome the disadvantage of the conventional polarization separator and to provide a polarization separator having a broad bandwidth for the high performance by providing a crossed waveguide as a main waveguide for propagating orthogonal polarized waves and at least one subwaveguide in a position where the propagating energy of one polarized wave is not substantially distributed.

The foregoing and the other objects of the present invention have been attained by providing a crossed waveguide type polarization separator which comprises a crossed waveguide for propagating orthogonal linear polarized waves, at least one conductor septum fitted in the crossed waveguide to totally reflect only one polarized wave of the linear polarized waves, at least one subwaveguide for receiving the linear polarized wave formed by the total reflection of the conductor septum, and a waveguide for receiving the other linear polarized wave which is not reflected by the conductor septum.

DETAILED DESCRIPTION OF THE PREFERRED EMBODIMENTS

Figure 1:
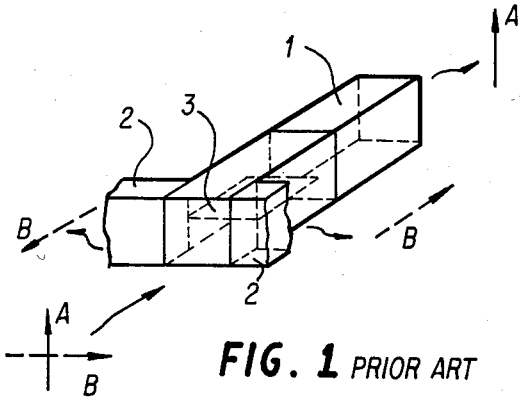
FIG. 1 PRIOR ART
FIG. 1 is a schematic view of the conventional polarization separator.

An embodiment of the present invention will be described with reference to drawings in which the same reference numerals designate the same or corresponding parts.

Figure 2:
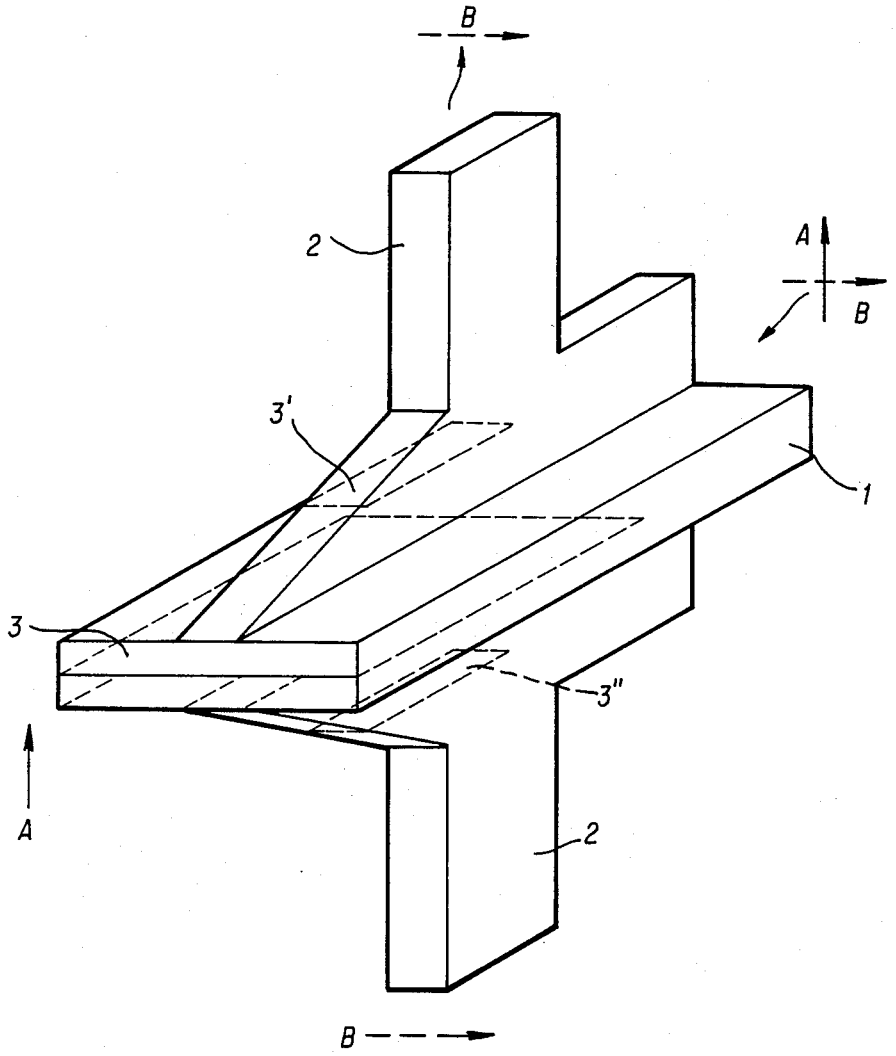
FIG. 2 is a schematic view of an embodiment of the present invention.
Figure 3A:
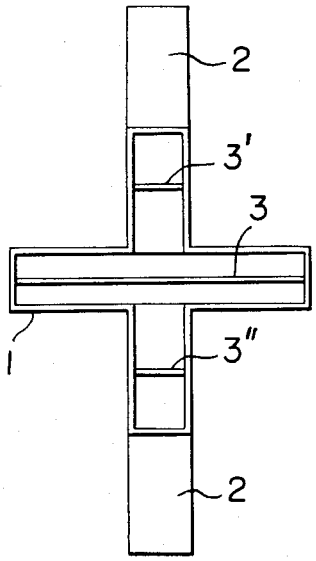
FIGS. 3(*a*) and 3(*b*) are respectively front and rear elevation views of the polarization separator of FIG. 2 in view of the propagating direction of wave.
Figure 3B:
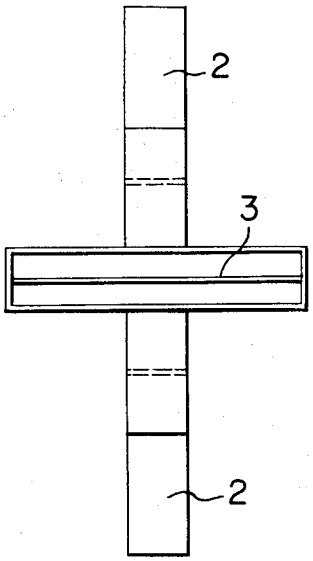
Figure 4:
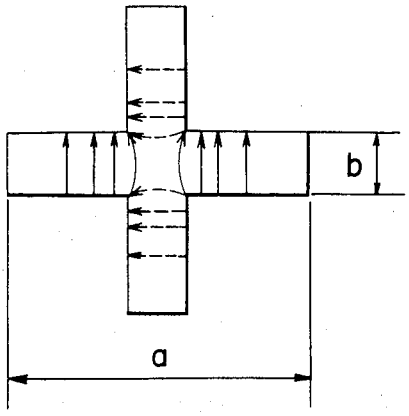
FIG. 4 is a schematic view showing electric field distributions in a crossed main waveguide.

FIG. 2 illustrates an embodiment of a crossed waveguide as a main waveguide. FIG. 3(*a*) is a front view of the crossed rectangular waveguide shown in FIG. 2 and FIG. 3(*b*) is a rear view of FIG. 2. FIG. 4 illustrates distributions of the electric fields of orthogonal polarized waves (A), (B) in the crossed waveguide (1), the figure being to simply illustrate the principle of the operation of the waveguide.

In the crossed waveguide for receiving two polarized waves (A), (B) as shown in FIG. 2, the polarized wave (B) is totally reflected by the conductor septums (3, 3′, 3″) to be separated into the subwaveguides (2) which are suitably positioned to the conductor septums (3, 3′, 3″) as it is clear in FIGS. 2, 3 and 4 because the polarized wave (B) has the electric field parallel to three conductor septums (3, 3′, 3″). The principle of wave separation in this case is the same with that of T type rectangular waveguide in the H plane which provides a broad bandwidth characteristic. The polarized wave (A) will be considered. It is clear from FIGS. 3 and 4 that the polarized wave (A) has an electric field perpendicular to the central conductor septum (3) and the conductor septums (3′, 3″) placed both sides of the central conductor septum, all septums (3, 3′, 3″) having a reduced thickness respectively. Accordingly, affect of three conductor septums (3, 3′, 3″) is not given to the polarized wave (A) throughout the broad bandwidth.

As it is clear from FIG. 4 showing the electric field distributions in a polarization separator of the present invention, the subwaveguides (2) for separating the polarized wave (B) are connected to the main waveguide in a position where the energy of the polarized wave (A) is not substantially formed whereby the polarized wave (A) is passed through the polarization separator without causing a substantial affect of the subwaveguide in a broad bandwidth. Thus, the polarization separator of the present invention has an excellent broad bandwidth characteristic.

Three conductor septums (3, 3′, 3″) are used in the embodiment described above. One or two or more than three conductor septums can be used in accordance with the principle of operation. In FIG. 4, the broad bandwidth characteristic can be obtained by giving dimension of height (b) smaller than that of width (a).

As described above, a subwaveguide for separating one polarized wave is connected to a cross waveguide in a position where the energy of the other polarized wave is not substantially distributed whereby a broad bandwidth characteristic can be obtained in comparison with the conventional waveguide.

We claim:

1. A crossed rectangular waveguide type polarization separator which comprises a crossed rectangular waveguide for propagating orthogonal linear polarized waves having a first rectangular portion perpendicular to a second rectangular portion, at least one conductor septum rectangular in shape fitted in said crossed rectangular waveguide to totally reflect only one polarized wave in said linear polarized waves in such a manner that said one polarized wave is reflected perpendicular to said at least one rectangular septum, at least a first subwaveguide for receiving said one linear polarized wave formed by the total reflection of said conductor septum, and a second subwaveguide for receiving the other linear polarized wave of said linear polarized wave which is not reflected by said conductor septum, wherein the width of said first rectangular portion is much greater than the height of said first rectangular portion, and wherein said at least one conductor septum has a central conductor septum and conductor septums, parallel to said central conductor septum, placed at both sides of said central conductor septum.

2. A crossed waveguide type polarization separator comprising:

a crossed waveguide having a first portion perpendicular to a second portion for propagating orthogonal linear polarized waves;

a central conductor septum centrally disposed in said first portion of said crossed waveguide to totally reflect only one polarized wave of said linear polarized waves;

a first conductor septum placed in said second portion of said crossed waveguide parallel to said central septum;

a second conductor septum placed in said second portion of said crossed waveguide parallel to said central conductor septum and on the opposite side of said central conductor septum from said first conductor septum;

at least one subwaveguide fitted to said second portion of said crossed waveguide for receiving said one linear polarized wave formed by the total reflection of said septums, whereby the other of said orthogonal linear polarized waves which is not reflected by said septums is passed through said polarization separator.

3. A crossed waveguide type polarization separator according to claim 2 wherein the width of said first and second portions of said crossed waveguide is much greater than the height of said first portion of said crossed waveguide in order to obtain broad band width characteristics from said polarization separator.

* * * * *